US010577900B2

(12) United States Patent
Di Crescenzo et al.

(10) Patent No.: US 10,577,900 B2
(45) **Date of Patent: *Mar. 3, 2020**

(54) EXPANSION ASSEMBLY, TOP ANCHOR AND METHOD FOR EXPANDING A TUBULAR IN A WELLBORE

(71) Applicant: SHELL OIL COMPANY, Houston, TX (US)

(72) Inventors: Daniele Di Crescenzo, New Orleans, LA (US); Djurre Hans Zijsling, Rijswijk (NL)

(73) Assignee: SHELL OIL OCMPANY, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/921,910

(22) Filed: Mar. 15, 2018

(65) Prior Publication Data

US 2018/0202268 A1 Jul. 19, 2018

Related U.S. Application Data

(63) Continuation of application No. 14/428,533, filed as application No. PCT/EP2013/069107 on Sep. 16, 2013, now Pat. No. 9,951,588.

(30) Foreign Application Priority Data

Sep. 18, 2012 (EP) ..... 12184850

(51) Int. Cl.
*E21B 43/10* (2006.01)
*E21B 33/129* (2006.01)
(Continued)

(52) U.S. Cl.
CPC ..... *E21B 43/105* (2013.01); *E21B 17/1078* (2013.01); *E21B 23/01* (2013.01); *E21B 33/129* (2013.01); *E21B 43/108* (2013.01)

(58) Field of Classification Search
CPC .... E21B 23/01; E21B 33/129; E21B 33/1291; E21B 33/1295; E21B 33/0422; E21B 43/105
(Continued)

(56) References Cited

U.S. PATENT DOCUMENTS 2,117,535 A 5/1938 Baker et al.
2,467,860 A 4/1949 Saurenman
(Continued)

FOREIGN PATENT DOCUMENTS

CN 101614114 A 12/2009
WO 2011023743 A2 3/2011

OTHER PUBLICATIONS

International Search Report and Written Opinion received for PCT Patent Application No. PCT/EP2013/069107 , dated Mar. 13, 2014, 8 pages.

*Primary Examiner* — Taras P Bemko

(57) ABSTRACT

An expansion assembly for expanding a tubular in a wellbore, the expansion assembly including a top anchor comprising: a workstring; a pusher ring being coupled to the workstring by a first releasable coupling; a ramp body having one or more ramp surfaces, said ramp body being releasably coupled to the workstring by a second releasable coupling; one or more anchor segments each having one or more wedge surfaces corresponding to and engaging the ramp surfaces of the ramp body, one end of the segments engaging the pusher ring; a release ring enclosing the workstring and arranged at an opposite end of the segments; one or more key merlons connecting the release ring to the pusher ring; and activating means for releasing the first releasable coupling.

17 Claims, 13 Drawing Sheets

(51) Int. Cl.
*E21B 23/01* (2006.01)
*E21B 17/10* (2006.01)

(58) Field of Classification Search
USPC ..... 166/382
See application file for complete search history.

(56) References Cited

U.S. PATENT DOCUMENTS

| | | | | |
|---|---|---|---|---|
| 3,036,640 | A * | 5/1962 | Clark, Jr. | E21B 23/01 166/214 |
| 4,648,446 | A * | 3/1987 | Fore | E21B 23/006 166/123 |
| 4,750,559 | A | 6/1988 | Greenlee et al. | |
| 5,566,762 | A | 10/1996 | Braddick et al. | |
| 6,325,148 | B1 | 12/2001 | Trahan et al. | |
| 7,090,037 | B2 | 8/2006 | Best | |
| 7,597,140 | B2 | 10/2009 | Filippov et al. | |
| 7,779,923 | B2 | 8/2010 | Holland et al. | |
| 7,992,644 | B2 | 8/2011 | Giroux | |
| 8,061,423 | B2 | 11/2011 | Lohbeck | |
| 8,251,161 | B2 | 8/2012 | Dithmar et al. | |
| 2009/0145666 | A1 | 6/2009 | Radford et al. | |
| 2012/0037381 | A1 * | 2/2012 | Giroux | E21B 23/01 166/382 |
| 2012/0160480 | A1 | 6/2012 | Wubben et al. | |
| 2013/0306329 | A1 | 11/2013 | De Crescenzo et al. | |

* cited by examiner

EXPANSION ASSEMBLY, TOP ANCHOR AND METHOD FOR EXPANDING A TUBULAR IN A WELLBORE

CROSS-REFERENCE TO RELATED APPLICATIONS

This is a Continuation application of U.S. application Ser. No. 14/428,533, filed 16 Mar. 2015, which is a US National stage application of International Application No. PCT/EP2013/069107, filed 16 Sep. 2013, which claims priority from European Application No. 12184850.1, filed Sep. 18, 2012. The disclosure of International Application No. PCT/EP2013/069107 is hereby incorporated by reference in its entirety.

FIELD OF THE INVENTION

The present invention relates to a system and method for anchoring an element within an enclosure.

BACKGROUND OF THE INVENTION

Embodiments of the present invention generally relate to an apparatus and method for expanding a tubular in a wellbore. More particularly, apparatus and method relate to a top anchor for a bottom hole assembly having an expandable tubular, an expansion member, the top anchor being configured to affix the expandable tubular to a downhole tubular.

In the drilling of oil and gas wells, a wellbore is typically formed using a drill bit disposed at a downhole end of a drill string that is urged downwardly into the earth. After drilling to a predetermined depth or when circumstances dictate, the drill string and bit are removed and the wellbore is lined with a string of casing. An annular area is thereby formed between the string of casing and the formation. A cementing operation is then conducted in order to fill the annular area with cement. The combination of cement and casing strengthens the wellbore and facilitates the isolation of certain areas or zones behind the casing. The drilling operation is typically performed in stages and a number of casing or liner strings may be run into the wellbore until the wellbore is at the desired depth and location.

Two challenges facing the Oil & Gas industry are accessing new reservoirs that currently cannot be reached economically and maintaining profitable production from producing older fields. Expandable tubular technology was initiated by the industry need to reduce drilling costs, increase production of tubing constrained wells and to enable operators to access reservoirs that could otherwise not be reached economically. Expanded casing applications concentrate on reducing the telescopic profile of well designs through a downhole tube expansion process.

Wellbores are generally provided with one or more casings or liners to provide stability to the wellbore wall, and/or to provide zonal isolation between different earth formation layers. The terms "casing" and "liner" refer to tubular elements for supporting and stabilising the wellbore wall. Typically, a casing extends from surface into the wellbore and a liner extends from a certain depth further into the wellbore. However, in the present context, the terms "casing" and "liner" are used interchangeably and without such intended distinction.

In conventional wellbore construction, several casings are set at different depth intervals, and in a nested arrangement. Herein, each subsequent casing is lowered through the previous casing and therefore has a smaller diameter than the previous casing. As a result, the cross-sectional area of the wellbore that is available for oil and gas production decreases with depth.

To reduce the loss of diameter each time a new casing string or liner is set, a cold working process has been developed whereby the casing or liner can be expanded by up to 25% in diameter after being run down-hole. The applications can be grouped into two main categories, being Cased hole and Open hole. Cased hole work is mainly done during the work over or completion phase of a well. The open hole expandable liner products are used during the drilling period of a well. Open hole applications is where expandable technology brings real advantages to the operator. The technology enables for instance slimmer well profiles, an increased inner diameter at target depth or the drilling of side tracks of existing wellbores.

Herein, one or more tubular elements are radially expanded at a desired depth in the wellbore, for example to form an expanded casing, expanded liner, or a clad against an existing casing or liner. Also, it has been proposed to radially expand each subsequent casing to substantially the same diameter as the previous casing to form a monodiameter wellbore. The available inner diameter of the wellbore remains substantially constant along (a section of) its depth as opposed to the conventional nested arrangement.

U.S. Pat. No. 6,325,148 discloses an apparatus for performing a downhole operation from the surface of a well. The apparatus comprises a tubular body forming a wall and a ring member disposed around the body. The ring member includes a plurality of slips and is held in frictional contact with an inner surface of an outer casing by a spring. A locking member mounted to the wall of the tool selectively prevents motion of said ring until said locking member is unlocked responsive to expansion of the wall of the tubular body.

U.S. Pat. No. 7,992,644 discloses a method of repairing a damaged portion of a casing in a wellbore. The method includes running a bottom hole assembly (BHA) into the wellbore on a conveyance and locating the BHA proximate the damaged portion. The method further includes engaging an inner wall of the casing with a friction member, rotating the conveyance thereby rotating a portion of the BHA, and maintaining a portion of the BHA stationary with the friction member. The method further includes pulling the inner string, thereby engaging the inner wall of the casing with an anchor of the BHA and disconnecting a frangible connection with the anchor. An inner string is coupled to an expansion member and pulling the inner string and thereby the expansion member through an expandable tubular expands the expandable tubular into engagement with the inner wall of the casing thereby repairing the damaged portion.

Although the tools of U.S. Pat. No. 7,992,644 functions properly, the tool has limitations. For instance, the friction member will always engage the casing, also during introduction of the BHA in the casing. The friction blocks of the friction member are required for activation of a top anchor, to prevent the top anchor from moving in axial direction during activation. Due to the friction of the friction blocks however, it is impossible to rotate the BHA while running the tool into the wellbore. Being unable to rotate the BHA limits the length along which the BHA and the expandable liner can be inserted in the wellbore. Also, the BHA is unsuitable for uncased wellbores. As some wellbores tend to be unstable and may collapse onto the expandable liner, rotation may be required to further advance the liner into the wellbore. If the BHA cannot be rotated, the expandable liner may become stuck in the wellbore due to friction, which may ultimately force an operator to plug and abandon the wellbore. In addition, the friction blocks may hinder or disable the return flow of drilling fluid. Also, scaling down the tool is limited due to material limitations of a release ring, i.e. due to the minimum force required to disconnect the frangible connection.

SUMMARY OF THE INVENTION

The present invention provides an expansion assembly for expanding a tubular in a wellbore, the expansion assembly including a top anchor comprising:

a workstring;

a pusher ring being coupled to the workstring by a first releasable coupling;

a ramp body having one or more ramp surfaces, said ramp body being releasably coupled to the workstring by a second releasable coupling;

one or more anchor segments each having one or more wedge surfaces corresponding to and engaging the ramp surfaces of the ramp body, one end of the segments engaging the pusher ring;

a release ring enclosing the workstring and arranged at an opposite end of the segments;

one or more key merlons connecting the release ring to the pusher ring; and activating means for releasing the first releasable coupling.

The expansion assembly of the invention can be hydraulically activated. The assembly can be rotated during run-in, allowing the assembly to be included in the drill string during drilling. The latter may save time for tripping in and out of the wellbore. Also, rotating the expansion assembly may allow the assembly to be forwarded when part of the wellbore wall may collapse, increasing maximum target depth and/or allowing drilling in unstable formations.

In an embodiment, the first releasable coupling including a first set of shear bolts providing a first threshold shear force, and the second releasable coupling including a second set of shear bolts having a second threshold shear force, said second threshold shear force exceeding the first threshold shear force.

Another aspect of the invention provides a top anchor for an expansion assembly of claim 1, the top anchor comprising:

a workstring;

a pusher ring being coupled to the workstring by a first releasable coupling;

a ramp body having one or more ramp surfaces, said ramp body being releasably coupled to the workstring by a second releasable coupling;

one or more anchor segments each having one or more wedge surfaces corresponding to and engaging the ramp surfaces of the ramp body, one end of the segments engaging the pusher ring;

a release ring enclosing the workstring and arranged at an opposite end of the segments;

one or more key merlons connecting the release ring to the pusher ring; and activating means for releasing the first releasable coupling.

According to still another aspect, the invention provides a method for expanding a tubular in a wellbore, the wellbore being provided with a casing, the method comprising the steps of:

introducing a tool string in the wellbore, the tool string being provided with an expansion assembly and a drill bit;

rotating the tool string including the drill bit and the expansion assembly to drill an open hole section of the wellbore until the drill bit reaches a target depth;

hydraulically activating a top anchor of the expansion assembly to anchor said assembly with the casing, by releasing a first releasable coupling;

pulling the tool string towards surface to release a second releasable coupling and to allow the tool string to move with respect to said top anchor;

using the tool string to pull an expansion member through an expandable liner towards the top anchor; and deactivating the top anchor.

BRIEF DESCRIPTION OF THE DRAWINGS

The invention will be described hereinafter in more detail and by way of example with reference to the accompanying drawings in which.

In the drawings and the description, like reference numerals relate to like components.

DETAILED DESCRIPTION

The present invention aims to provide an improved expandable liner tool.

Figure 1:
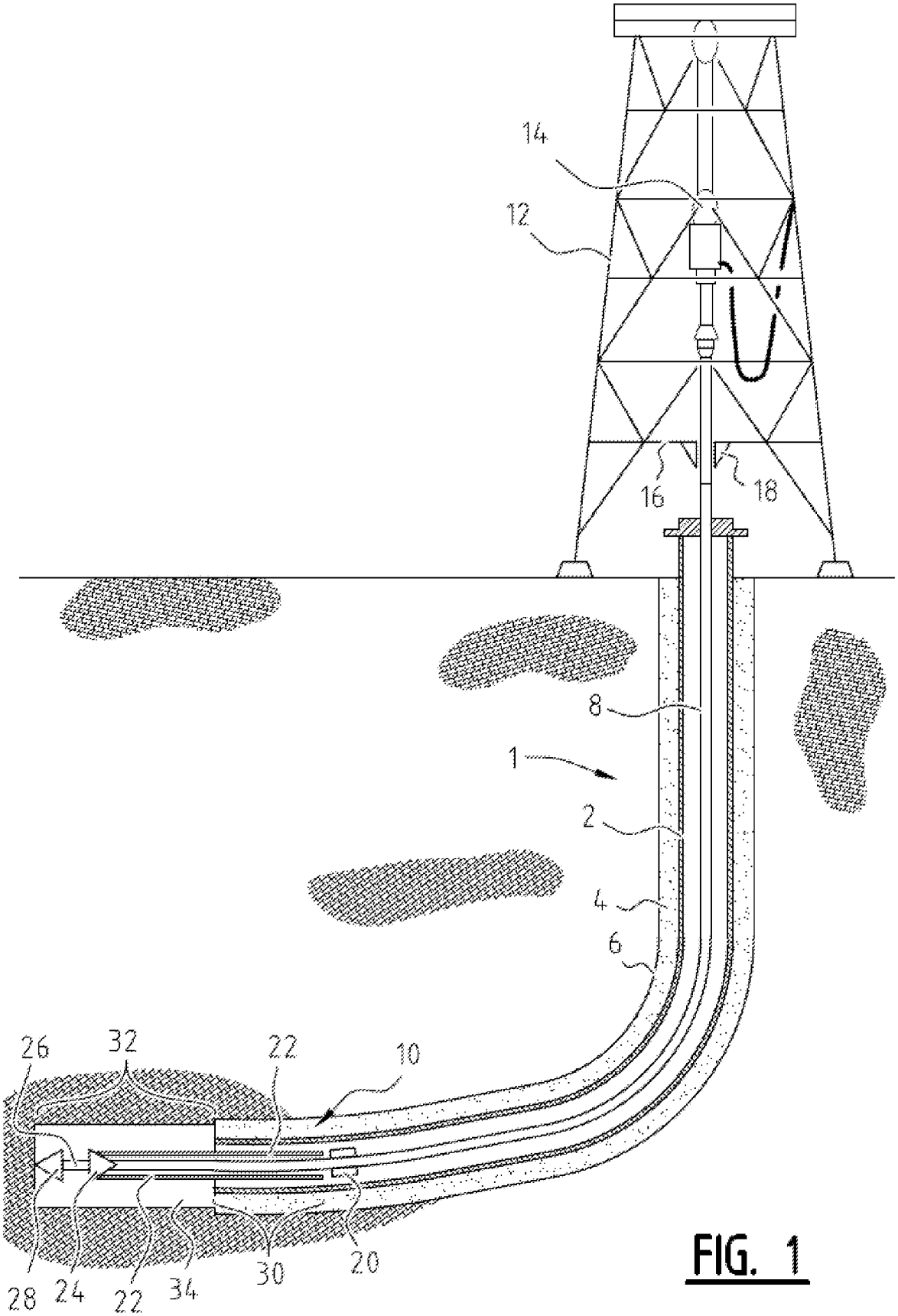
FIG. 1 shows a schematic cross-section of a wellbore including an embodiment of the system according to the present invention.

FIG. 1 shows a wellbore 1 which includes a casing 2 cemented into place by cement 4 in the annulus between the casing and the wellbore wall 6. A tool string 8 extends into the wellbore having an expansion assembly 10 at its downhole end. At surface, the tool string 8 is connected to a drilling rig 12. The drilling rig may typically include a hoisting assembly 14, a drill floor 16 and gripping member 18. The drilling rig 12 may be onshore, as shown in FIG. 1, or offshore.

The tool string 8 is used to convey and manipulate the expansion assembly in the wellbore 1. The tool string 8, as shown, is a drill string. However, the conveyance may be any suitable conveyance, including but not limited to, a tubular work string, production tubing, drill pipe or a snubbing string.

The expansion assembly 10 includes a top anchor 20, an expandable tubular 22, and an expansion member 24. The expansion assembly 10 is coupled to the tool string 8 which allows the expansion assembly 10 to be conveyed into the wellbore and manipulated downhole from the surface. The top anchor 20 may be any suitable device for anchoring the expansion assembly 10 to the casing 2 including, but not limited to slips, dogs, grips, wedges, or an expanded elastomer.

An additional section 26 of the tool string 8 may be provided below the expansion member 24, which may be provided with a drill bit 28 and/or an under reamer (not shown separately) for drilling the wellbore at the downhole end thereof.

The drill bit 28 may be operated to drill an open hole section 32 of the wellbore. The expansion assembly 10 may be run into the wellbore 1 on the tool string 8 while drilling the wellbore, until it reaches a desired location. Herein, the expandable liner 22 typically partly overlaps the casing 2 in an overlap section 30 and partly extends into the newly drilled open hole section 32. In the open hole section 32, an annular space or annulus 34 is defined between the liner 22 and the wellbore wall 6.

The top anchor 20 may then be actuated in order to engage the expansion assembly 10 with the casing 2. With the setting assembly 20 engaged to the casing 2, the tool string 8 may be pulled up and thereby pull the expansion member 24 through the expandable tubular 22 to expand the latter. The tool string 8 may transfer torque, tensile forces and compression forces to the expansion member 24. Fluid may be pumped down the tool string 8 during the expansion in order to lubricate the expansion member 24 during expansion.

Figure 2:
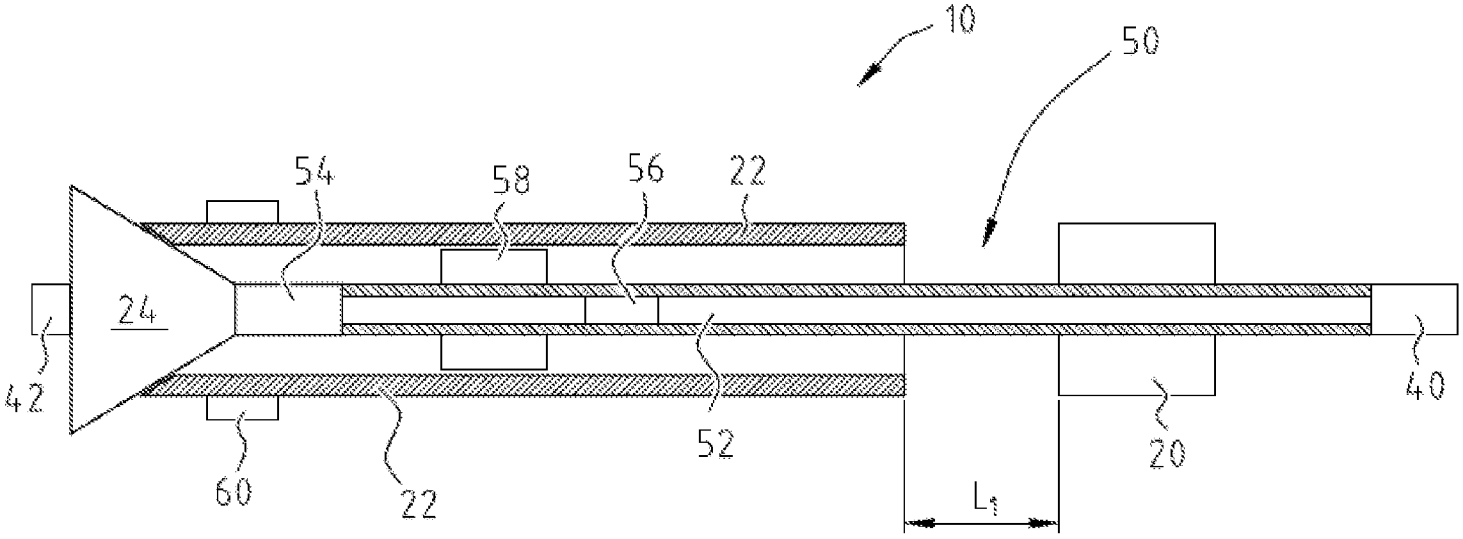
FIG. 2 shows a cross section of an embodiment of the system according to the invention.

As shown in FIG. 2, the expansion assembly 10 may include a first connector 40 to be coupled to the tool string 8. The opposite, downhole end of the expansion assembly 10 may include a second connector 42 to be coupled to the additional tool string section 26. The first connector 40 and the second connector 42, as described herein, are threaded connections. However, first connector and second connector may be any suitable connection including, but not limited to, a welded connection, a pin connection, or a collar.

Figure 3:
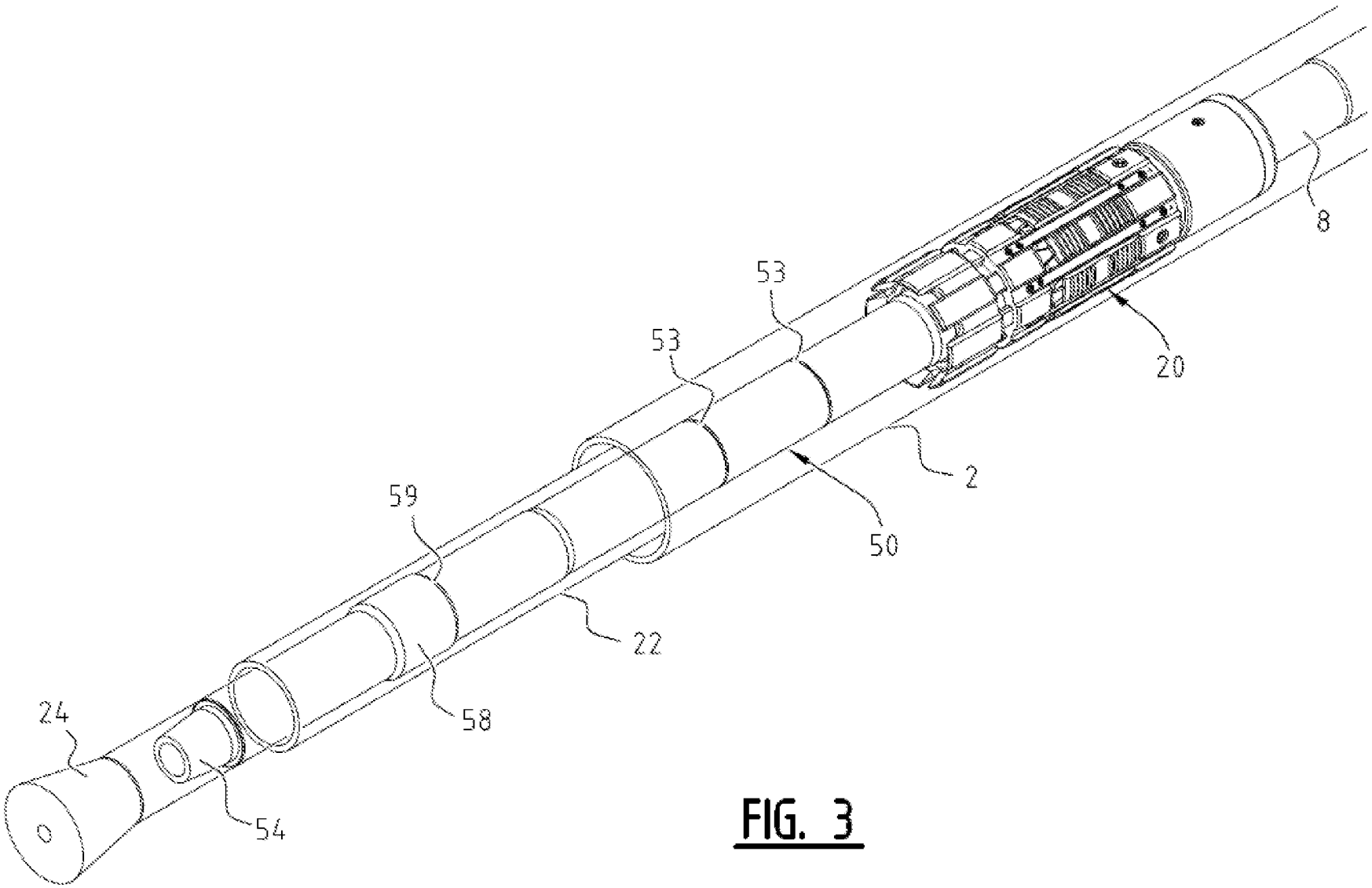
FIG. 3 shows a perspective view of the system of the invention.
Figure 4:
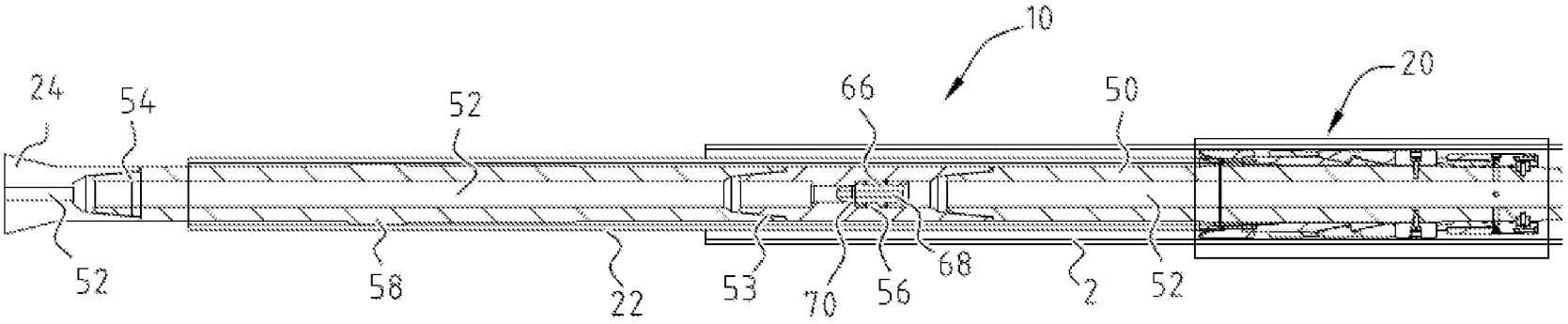
FIG. 4 shows a cross section of an embodiment of the system according to the invention, including a top anchor in a disengaged state.
Figure 5:
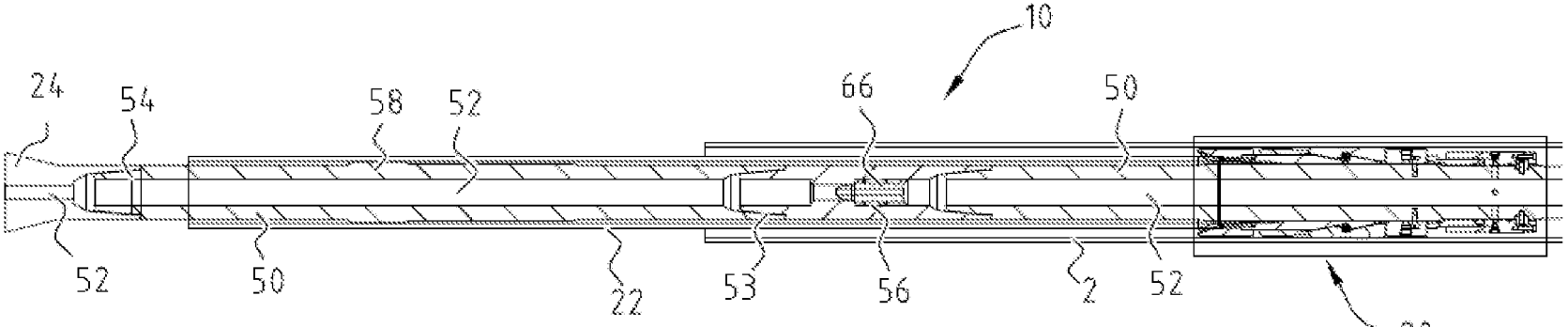
FIG. 5 shows a cross section of the system of FIG. 4, including a top anchor in an engaged state.

The expansion assembly 10 includes a workstring 50 which is provided with the first connector 40 at one end and with the second connector 42 at the opposite end. The work string is provided with an internal fluid passage 52. The work string 50 may be a string of drill pipe sections. Preferably, said drill pipe section are connected to each other using threaded connections 53 having externally flush surfaces, as shown in FIGS. 3-5. The workstring 50 includes a third connector 54 to which the expansion member 24 is connected. A dart catcher 56 may be provided in the fluid passage 52. The dart catcher can be used for hydraulic activation of the expansion assembly. The outside surface of the workstring 50 may be provided with a release sub 58. The release sub 58 may include a ridge having an increased outer diameter relative to the workstring 50, as shown in FIGS. 3-5. Said ridge may be provided with a ridge chamfer 59.

Optionally, the outside surface of the downhole end of the expandable liner 22 may be provided with an open hole anchor 60 (FIG. 2), for engaging the wellbore wall 6 in the open hole section 32. Once an initial portion of the expandable tubular 22, including the open hole anchor, has been expanded, said anchor will engage the wellbore wall 6, anchoring the expanded tubular 22 in position. For instance WO-2011/023743 discloses an open hole anchor which is suitable for the expansion assembly 10.

The expansion assembly 10 may provide a distance L1 between the top anchor 20 and a top end of the expandable liner 22 (FIG. 2). The distance L1 prevents the top anchor 20 from engaging the top end of the liner 22 during run-in of the assembly into the wellbore, which may prevent damage to both the top anchor and to the top end of the liner. In practice the liner end and the top anchor may however also engage each other during run-in. In a practical embodiment, the distance L1 is for instance in the range of 0 to 3 meter, for instance about 1 to 2 meter. Upward movement of the expandable liner during run-in may be prevented by a releasable connection (not shown) between the liner end and the expansion cone 24. Such connection may include a threaded connection which is designed to fail when the expansion process commences.

Figure 6:
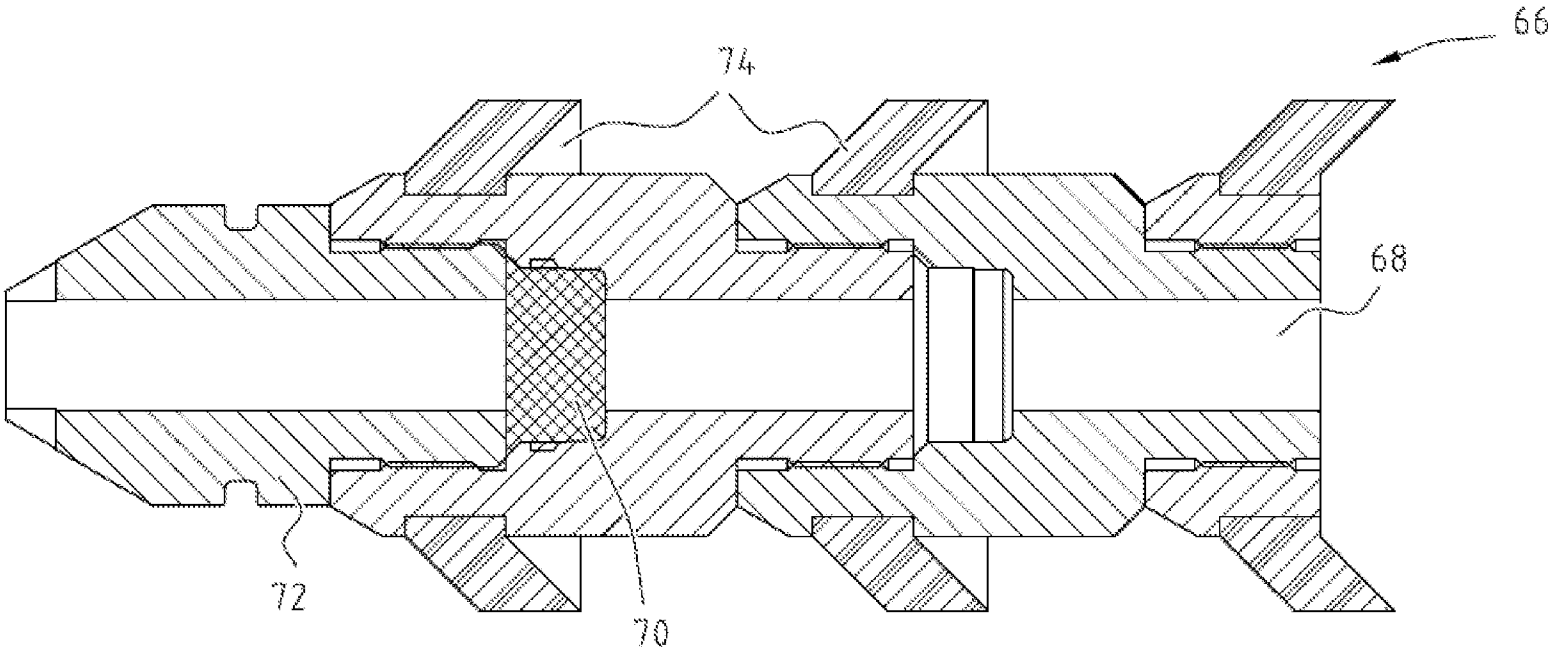
FIG. 6 shows a cross section of an embodiment of a dart of the system of the invention.
Figure 7:
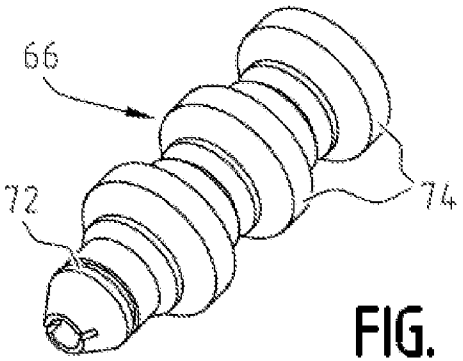
FIG. 7 shows a perspective view of the dart of FIG. 6.

FIGS. 5 and 6 show dart 66 located in the dart catcher 56. The dart 66 can be dropped from surface and pumped down the fluid channel 52 until the dart engages the dart catcher and subsequently blocks the fluid channel 52.

In an embodiment, the dart 66 include a dart fluid channel 68 which is aligned with the fluid channel 52, and a burst disc 70 blocking said dart fluid channel 68 (FIGS. 4, 6). The dart may comprise a cylindrical body 72. Said body 72 may typically be made of a metal. The dart may optionally be provided with one or more extending flanges 74, which may be made of an elastomer. The body 72 and the optional flanges 74 typically have an outer diameter which is smaller than the inner diameter of the fluid channel 52, but exceeds the inner diameter of the dart catcher 56.

The burst disc 70 will burst when a pressure differential across the disc exceeds a threshold burst pressure. Thus, the burst disc allows re-opening of the fluid channel 52. The dart body may be made of an erodible material, such as aluminium, allowing opening of the fluid channel by eroding the dart body. The fluid passage 52 may subsequently be closed again by dropping another dart into the fluid channel 52. Opening the fluid channel 52 may be required to regain control over the well in case of a well control incident (blowout). Also, circulation may assist the expansion process, which is also referred to as hydraulically assisted expansion.

In a practical embodiment, the burst disc 70 may be rated at a burst pressure in the range of 4,000 to 6,000 psi, for instance about 5,000 psi (345 bar) at 20 degree C.

Figure 8A:
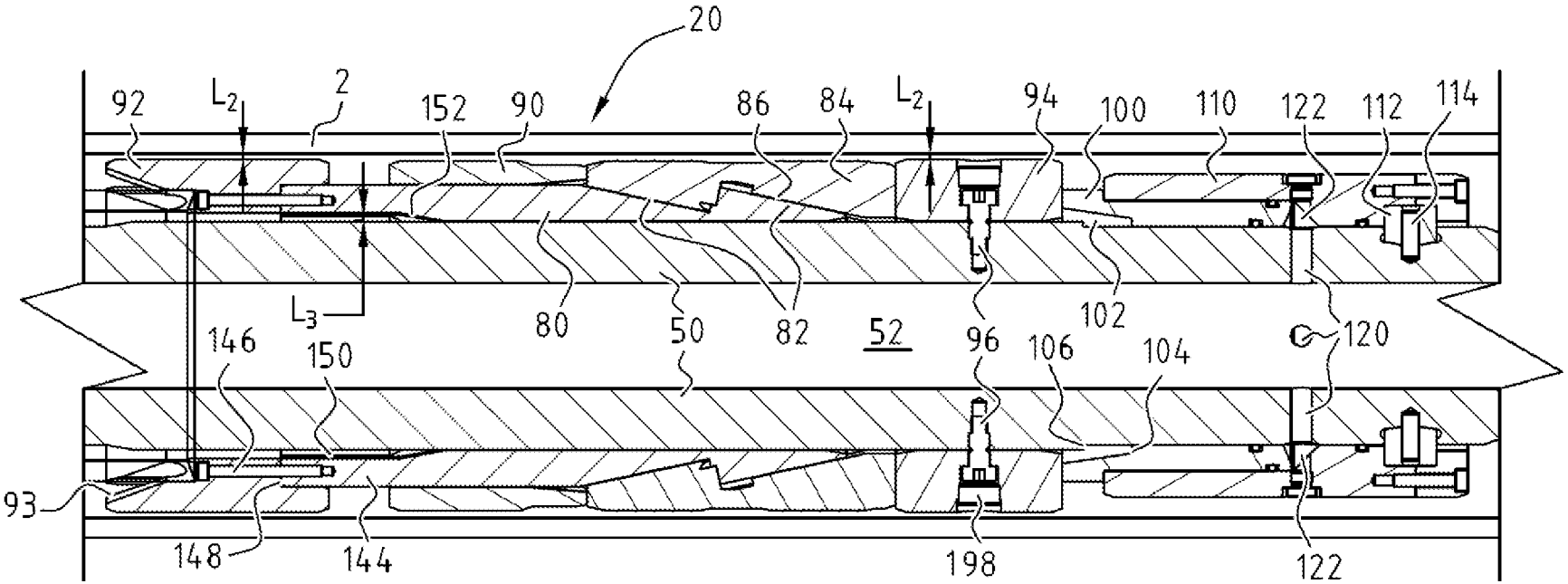
FIG. 8A shows a cross section of an embodiment of the top anchor in a disengaged state.
Figure 8B:
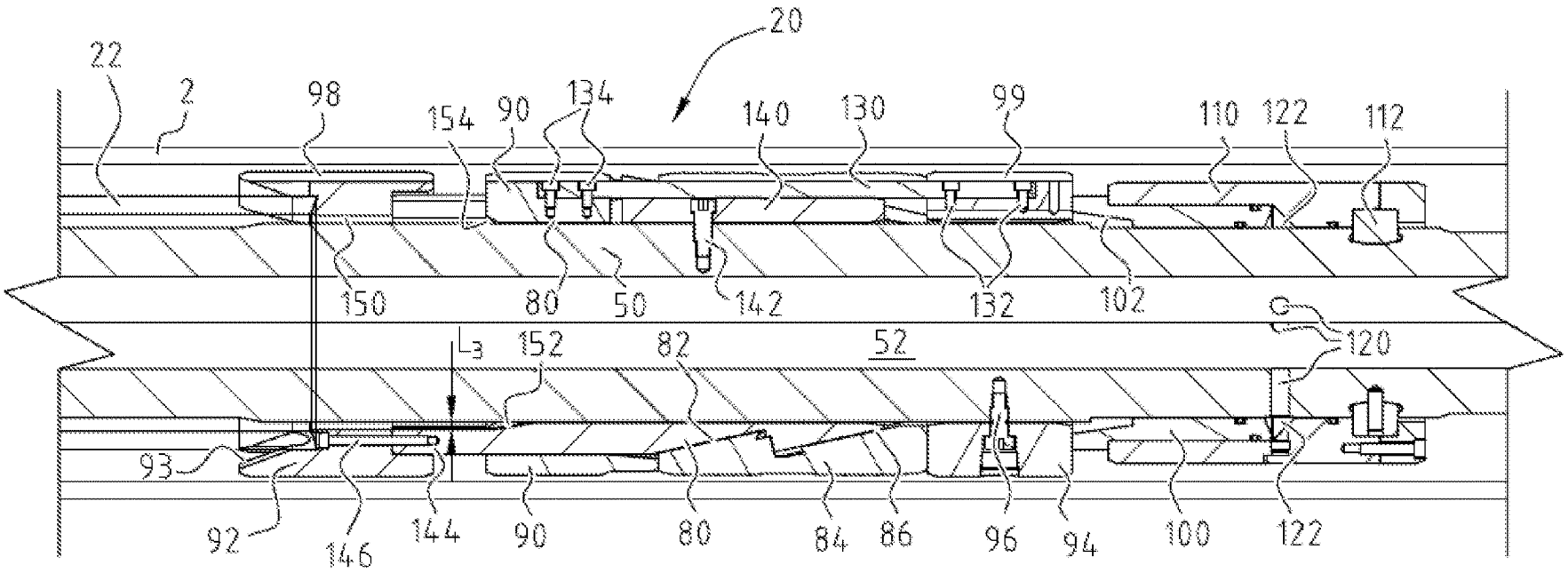
FIG. 8B shows another cross section of the top anchor of FIG. 8A.
Figure 8C:
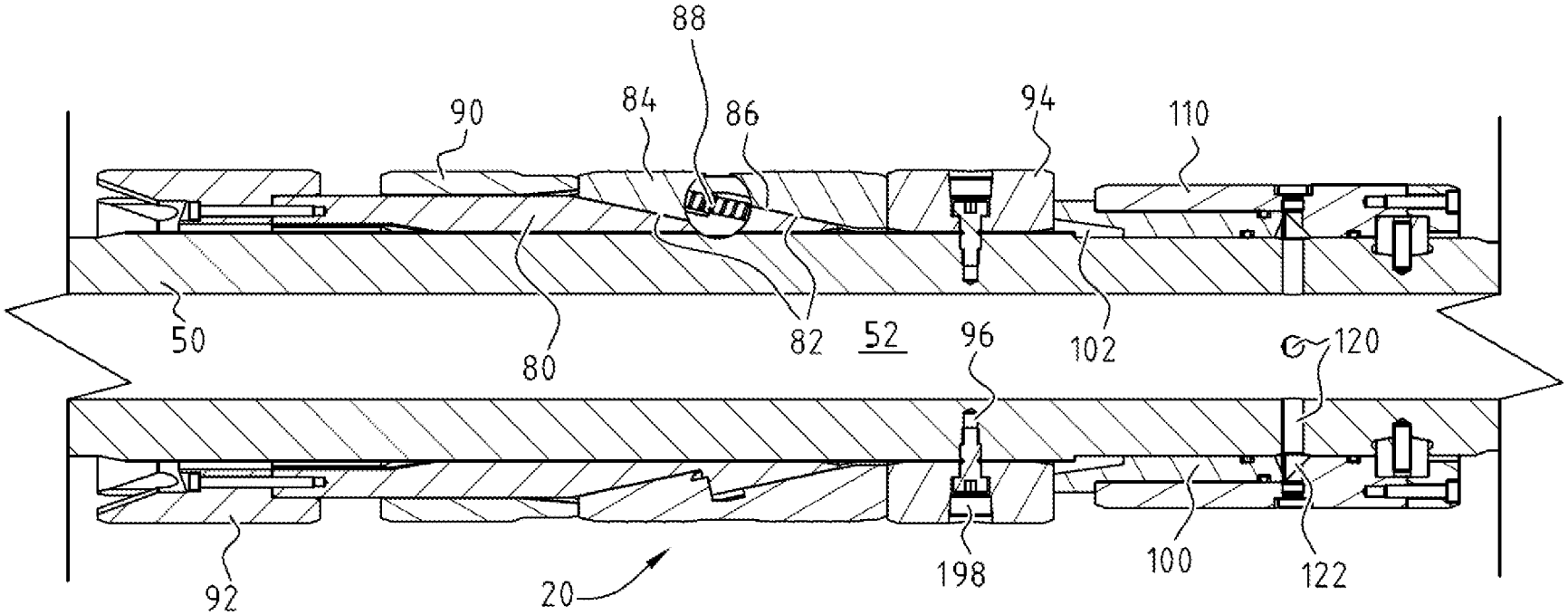
FIG. 8C shows yet another cross section of the top anchor of FIG. 8A.

As shown in more detail in FIGS. 8A-8C, the top anchor 20 in an unactivated state fits within the casing 2, leaving a small clearance L2 (FIG. 8A). Depending on the inner diameter of the casing, said clearance L2 may be in the range of about 1 mm to 5 mm, for instance about 3 mm.

The top anchor 20 may comprise one or more ramp bodies 80, having one or more ramp surfaces 82 and being arranged on the outside of the workstring 50. One or more anchor segments 84 have complementary wedge surfaces 86 engaging and moveable with respect to the ramp surfaces 82 of the ramp bodies. Typically, the top anchor will include a number of anchor segments 84, being equally distributed along the circumference of the top anchor (see also FIG. 10). Each anchor segment co-operates with a corresponding longitudinal ramp body. One or more spring members 88 may be provided to pre-load a respective anchor segment 84 with respect to the corresponding ramp body 80 (FIG. 8C).

A release ring 90 may enclose the one or more ramp bodies 80. At its downhole facing end, the top anchor may comprise a centralizer ring 92 engaging the ramp bodies 80. The centralizer ring is preferably provided with a centralizing chamfer 93, for catching and guiding the end of the liner 22 to a predetermined position (see for instance FIG. 8B). At the opposite end, the anchor is provided with pusher ring 94 engaging the anchor segments 84. Said pusher ring is releasably connected to the workstring 50, for instance using one or more shear bolts 96. Optionally, the shear bolts may be covered by a retaining ring 198. The shear bolts may be set to break when a shear force exceeds a first threshold shear force. In a practical embodiment, said first threshold shear force may be in the range of 2 to 3 metric ton, for instance about 2.5 ton, pre shear bolt. The total threshold shear force is a multiple of the number of bolts. The pusher ring 94 may be connected using four shear bolts, setting the total first shear force at about 10 ton.

To protect the outside surfaces of the centralizer 92 and/or the pusher ring 94, said surfaces may be provided with a layer of relatively hard material 98, 99 (FIG. 8B), such as tungsten carbide, relatively hard steel, or a similar material. The material may be applied by a hardfacing process, wherein powder metal alloys are applied and hardened using a welding system.

A rod member 100 may be provided next to the pusher ring. A circular cavity 102 may be provided between said rod member and the workstring 50, to allow sliding movement of the rod member along the workstring limited by the engagement of a rod shoulder 104 and a workstring shoulder 106. A cylindrical cover 110, which covers and guides the rod member 100, may be connected to the workstring, for instance by a key 112 and one or more pins 114.

The workstring may be provided with one or more fluid openings 120, to provide a fluid passage from the fluid channel 52 to a fluid cavity 122 which is enclosed by the cover 110 and the rod member 100. Optionally, said fluid cavity and/or the fluid openings may be filled with a pressure transfer material. Said pressure transfer material may include a gel, such as Laponite® marketed by Rockwood Additives Limited. The gel will prevent clogging of the openings by solids in the drilling fluid.

Figure 10:
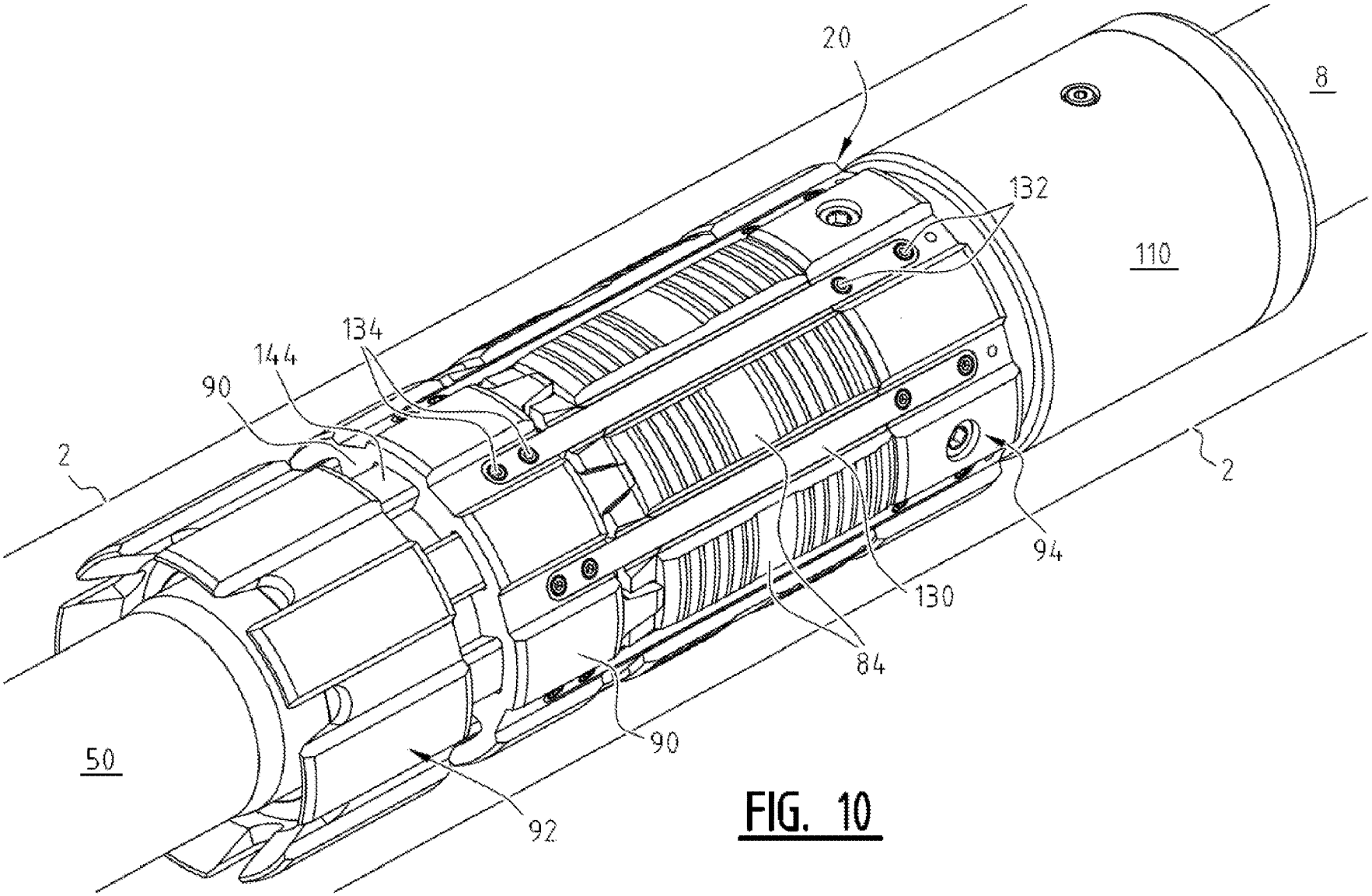
FIG. 10 shows a perspective view of an embodiment of the top anchor.
Figure 11:
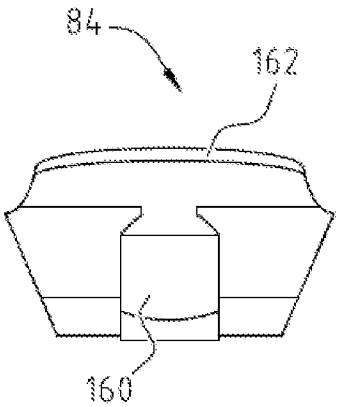
FIG. 11 shows a front view of a anchor segment of the top anchor.
Figure 12:
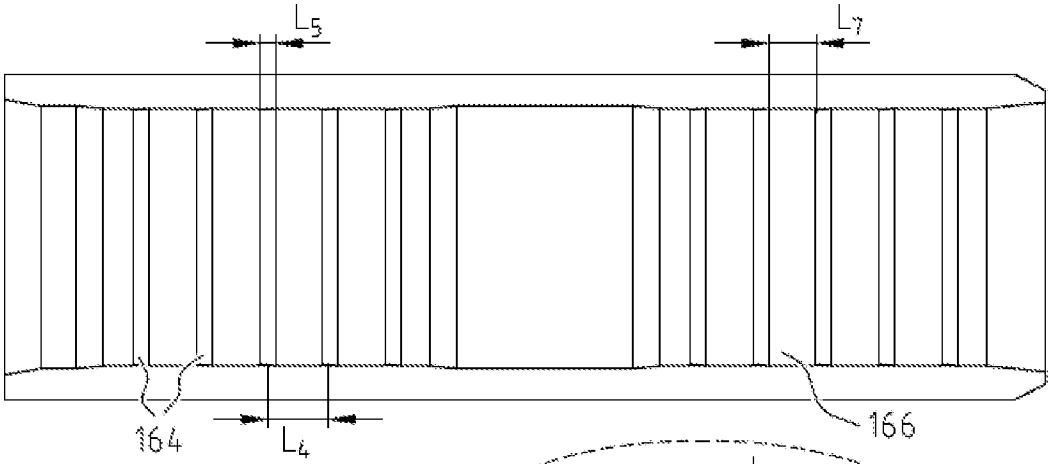
FIG. 12 shows a plan view of a anchor segment of FIG. 10.
Figure 13:
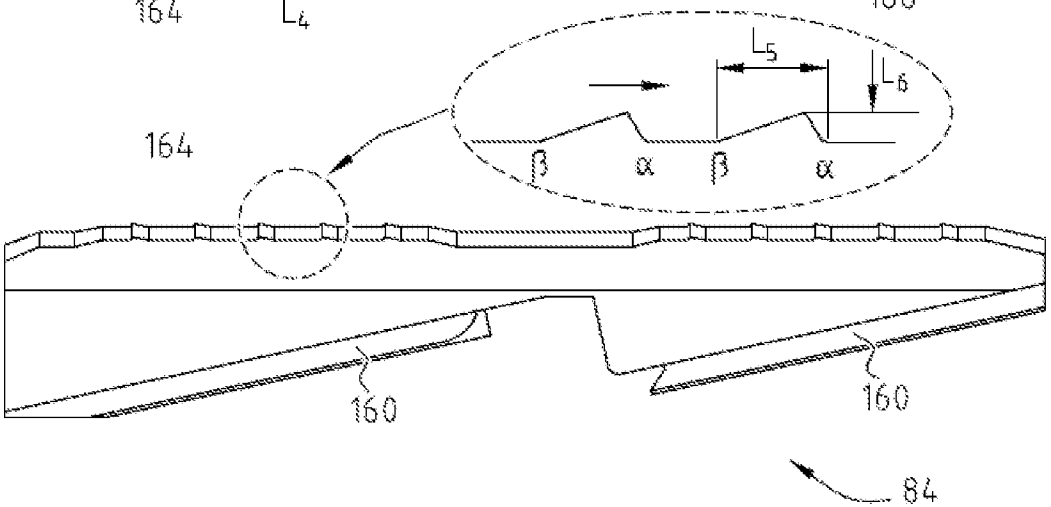
FIG. 13 shows a side view of the anchor segment of FIG. 10.

The pusher ring 94 may be provided with one or more key merlons 130 extenting longitudinally between adjacent anchor segments 84 (FIGS. 8B, 10). The key merlon is at one end connected to the key ring 94 and at the opposite end connected to the release ring 90, for instance using bolts or pins 132-134. The anchor segments are shut in between the pusher ring 94 and the release ring 90.

Cylindrical body part 140 is connected to, and may preferably be integrally formed with, the one or more ramp bodies 80 (FIG. 8B). The body part 140 encloses the work string 50 and is able to slide with respect to said workstring. The body part 140 is releasably connected to the workstring. Said releasable connection for instance includes one or more shear bolts 142, which may be set to break when a shear force exceeds a second threshold shear force.

In a practical embodiment, said second threshold shear force may be in the range of 4 to 6 metric ton, for instance about 5 ton, per shear bolt. The body part 140 may be connected using four shear bolts, for instance setting the total second shear force at about 20 ton. The (total) second threshold shear force is greater than the (total) first threshold shear force.

During drilling, the expansion assembly of the invention will be rotated, including the top anchor. As the top anchor may engage the inner surface of the casing 2, friction due to rotation will cause circumferential stresses in the anchor. In the embodiment shown in FIGS. 8A-8C, the shear force required to shear the first set of shear bolts and the second set of shear bolts 142 is set to exceed the circumferential force caused by friction during drilling. The top anchor can be designed to withstand for instance about 2 to 5 kNm torque.

In an improved embodiment, the outer surface of the workstring 50 may be provided with one or more cams, longitudinal ribs or similar extensions (not shown). The inner surfaces of the pusher ring 94 and/or the anchor body 80 may be provided with corresponding grooves, allowing the pusher ring 94 and the anchor body to slide along the extensions in longitudinal direction, but blocking movement in circumferential direction. Thus, said extensions will provide a reaction force countering the circumferential force caused by friction during rotation of the top anchor. The improved embodiment, including said extensions and grooves, can for instance withstand up to 5 kNm, which far exceeds frictional forces during typical drilling operations.

The ramp bodies 80 and/or the body parts 140 may be provided with one or more fingers 144. An end of the fingers may be connected to the centralizer ring 92, for instance by connector 146 which may include a bolt or pin. In the embodiment shown in FIG. 8A, the end of the finger 144 may engage a centralizer shoulder 148. A clearance 150 may be arranged between the centralizer 92 and the one or more fingers 144 on one side and the workstring 50 on the other. Said clearance may be annular, having a minimal radial distance L3 (FIG. 8B). In a practical embodiment, distance L3 may be in the range of 1 to 10 mm, for instance about 5 mm. A ramp body chamfer 152 is provided at the inner surface of the ramp bodies 80, which closes said clearance between the ramp body and the workstring. The clearance preferably allows passage of the release sub 58 (FIG. 3), i.e. a height of the ridge 58 is preferably smaller than radial distance L3. An edge of the release ring 90 facing the workstring 50 is provided with a release ring chamfer 154. Preferably, the release ring chamfer 154 matches the ridge chamfer 59 of the release sub 58.

The one or more fluid openings 120 enable hydraulic activation of the top anchor. Herein, the fluid channel 52 may be blocked by dropping the dart 66 into the dart catcher 56 (FIG. 5). Thereafter, the pressure of the drilling fluid can be increased, consequently also increasing the pressure in the fluid chamber 122. Said fluid pressure will cause the rod member 100 to push against the pusher ring 94. To activate the anchor, the pressure of the drilling fluid can exceed a threshold pressure, which causes the pushing force of the rod member 100 against the pusher ring to exceed the shear force of the shear bolts 96.

Figure 9:
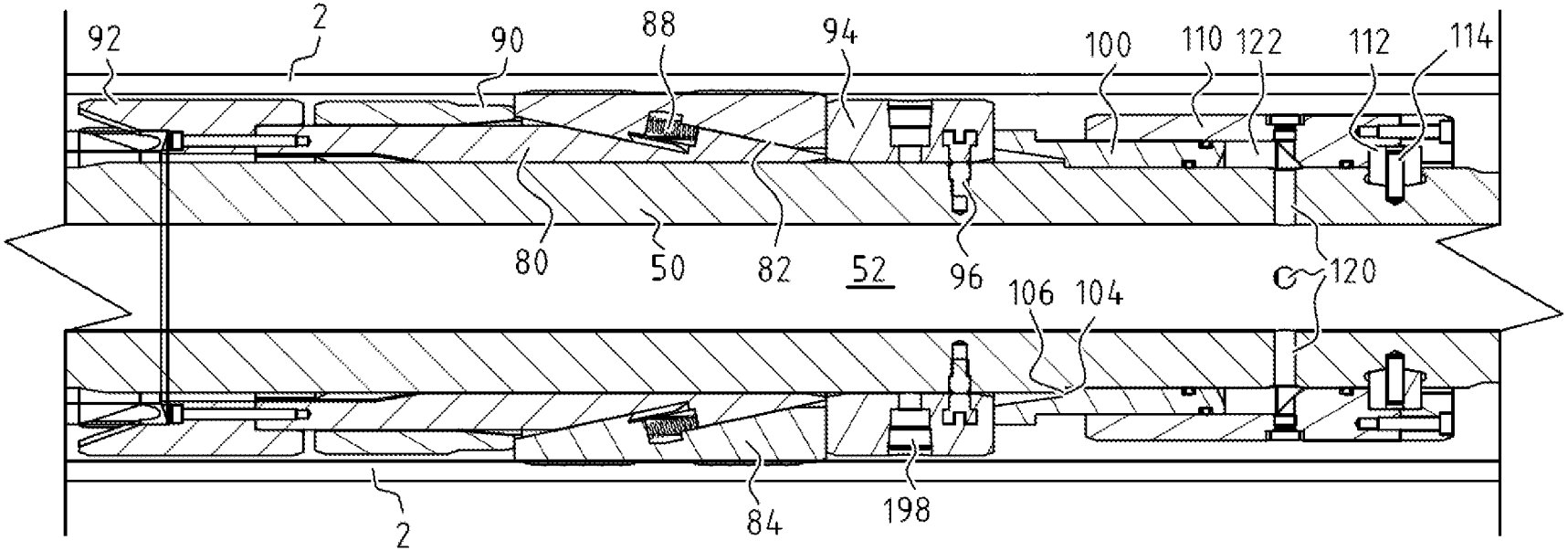
FIG. 9 shows a cross section of the top anchor of FIG. 8 in an engaged or activated state.

As shown in FIG. 9, when the pressure exceeds the threshold pressure, the shear bolts 96 will shear (break), allowing the pusher ring to slide along the workstring. The pusher ring pushes the anchor segments 84 onto the ramp surfaces 82, causing the segments to move radially outward towards the casing 2. The outer surface of each segment will engage the casing. The sliding movement may be limited by the rod shoulder 104 engaging the workstring shoulder 106 (FIG. 9), which also limits the outward movement of the segments and prevents damage to the casing 2.

The springs 88 also push the segments radially outward. In an embodiment, the springs 88 are helical springs. The force Fs exerted by each spring depends on the compression, i.e. Fs=k(Ls−Lc), wherein k is a spring constant, Ls is the length of the spring when uncompressed, and Lc is the length of the spring when compressed. In a practical embodiment, the total spring force may be designed to be in the range of 150-200 kg (1.5-2 kN) when the anchor 20 is inactive (FIG. 8C), and in the range of 20-50 kg, for instance about 30 kg (0.3 kN) when the top anchor is activated (FIG. 9).

A bottom surface of the anchor segments may be provided with a dovetail shaped ridge 160, fitting into a correspondingly shaped guide channel (not shown) of the corresponding ramp surface 82, together forming a sliding dovetail joint. An outer surface 162 facing the casing 2 may be provided with teeth 164. The teeth may be located at a mutual distance or pitch L4. Each tooth may have a width L5, a height L6, a forward angle α and an aft angle β.

In a practical embodiment, the width L5 is smaller than the pitch L4, creating a flat surface 166 between adjacent teeth 164. The pitch may be in the order of 10-30 mm, for instance about 15-20 mm. The width L5 may be in the order of 4-10 mm, for instance about 6-7 mm. The height L6 of the teeth may be in the order of 1-2 mm. The pitch L7 may be in the range of about 7-12 mm, for instance about 9-10 mm. The forward angle α is preferably less than 90 degrees. The forward angle α may be in the range of 40 to 80 degrees, for instance about 60 degrees. The aft angle β may be in the range of about 5 to 30 degrees, for instance about 10 degrees. The relatively modest forward angle α provides sufficient grip to the casing inner surface while the top anchor is activated, while facilitating easy release and preventing damage to said inner surface of the casing. Herein, the relatively low aft angle β improves the easy release from the casing when the anchor is deactivated.

The expansion process of the invention is described with references to FIGS. 14-18.

Initially, the open hole section of the wellbore is drilled, using drill bit 28 as shown in FIG. 1, until the expansion assembly 10 reaches a predetermined position. Herein, the bit has reached a depth which may also be referred to as target depth TD (FIG. 14).

The expansion assembly of the invention is connected to the drill string 8. During drilling, either the drill string may be rotated from surface, or the drill bit may be driven by a downhole motor which can be included in the drill string section 26. If the drill string is rotated from surface, the expansion assembly of the invention will be rotated together with the drill string, including the expandable liner 22 and the top anchor 20. Drilling torque will be transferred via the workstring 50, so that rotational forces to the expansion assembly are limited to frictional forces due to engagement of the inner surface of the casing 2 or the wellbore wall 6.

Figure 14:
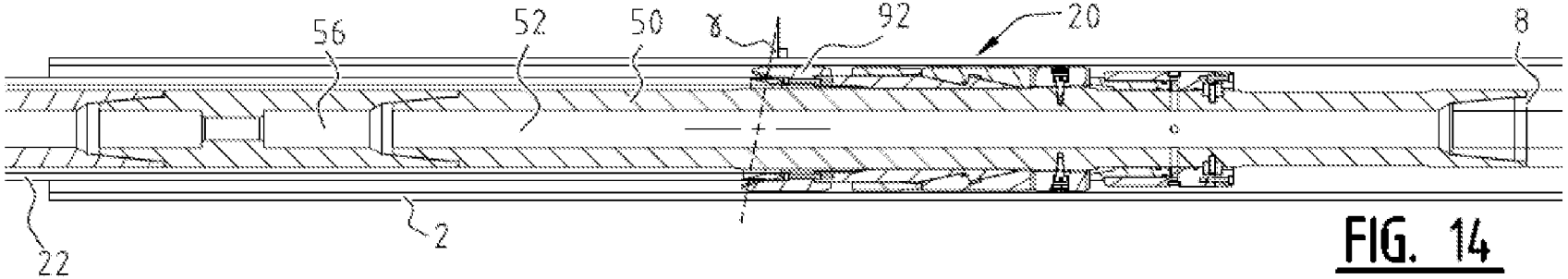
FIGS. 14-18 show a cross section of the system of the invention, indicating subsequent steps in a method according to the invention.

As shown in FIG. 14, the downhole end of the centralizer ring may be arranged at an angle γ with respect to the radial plane of the top anchor 20. Herein, the angle γ>0 degrees. During drilling, the anchor will be rotated, wherein the angle γ will ensure that the centralizer properly engages the top end of the liner 22. In practice, the angle γ may be in the range of about 5 to 15 degrees.

After reaching target depth, optionally cement may be pumped via the fluid channel 52 through the drill bit 28 and into the annulus 34 between the liner 22 and the wellbore wall 6. Said cement is initially a slurry, which will harden after a predetermined time period. Said time period can be designed to exceed the time required to perform the expansion steps described herein below.

Figure 15:
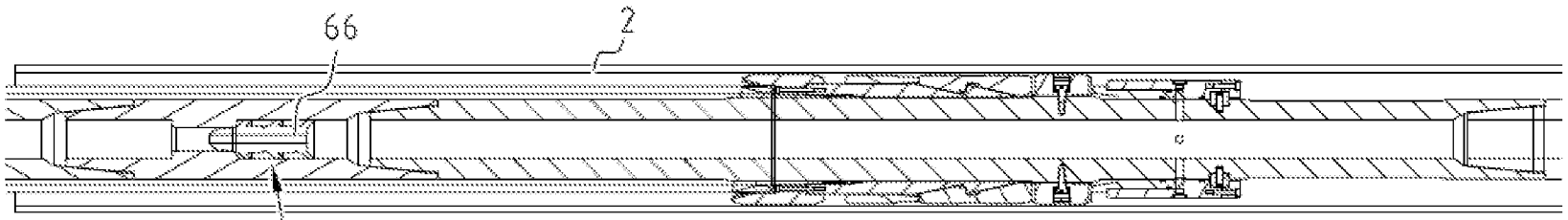

Subsequently, the fluid channel 52 is blocked, for instance by pumping the dart 66 into the fluid channel 52 until the dart reaches and blocks the dart catcher 56 (FIG. 15).

Figure 16:
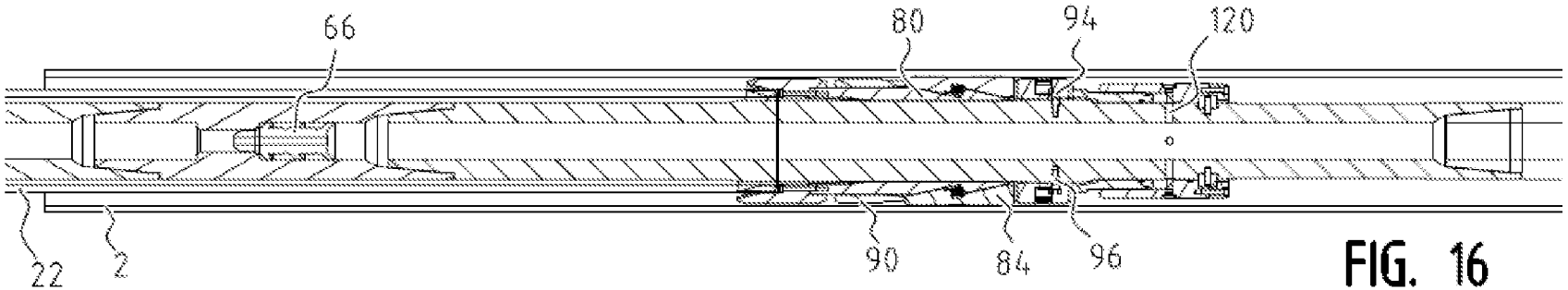

In a next step, the fluid pressure in the fluid channel uphole of the dart is increased (FIG. 16). The pressure is transferred via the openings 120 to the pusher ring 94, as also described above with respect to FIG. 9. The pressure is increased until the force exerted by the pusher ring exceeds the first threshold force which shears the first set of shear bolts 96. Said first threshold shear force is for instance about 8-12 metric ton. After shearing of the first set of shear bolts, the pusher ring pushes against the segments which slide onto the ramp surfaces 82 and radially outward against the casing 2. The anchor segments engage the inner surface of the casing 2 and the top anchor is activated (see also FIG. 9).

Figure 17:
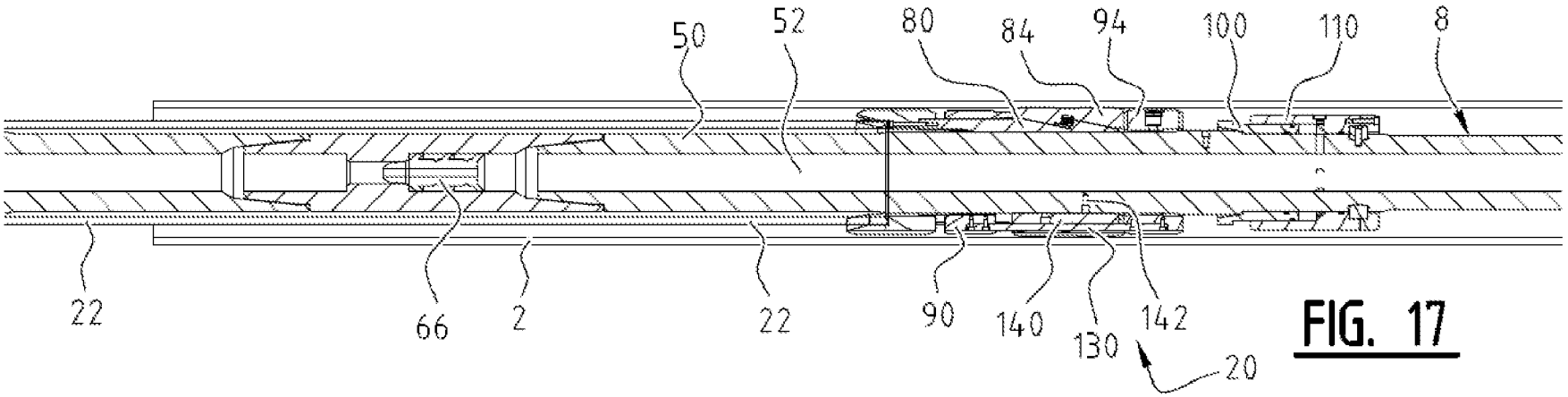

Subsequently, the drill pipe 8 is pulled in the uphole direction, causing the workstring 50 to exert a shear force to the second set of shear bolts 142. The force applied to the drill string is increased until it exceeds the second threshold shear force, causing the second set of shear bolts 142 to shear (FIG. 17). Said second threshold shear force is for instance about 18-22 metric ton. When the second set of shear bolts are sheared, the workstring 50 is able to move with respect to the top anchor 20.

Figure 18:
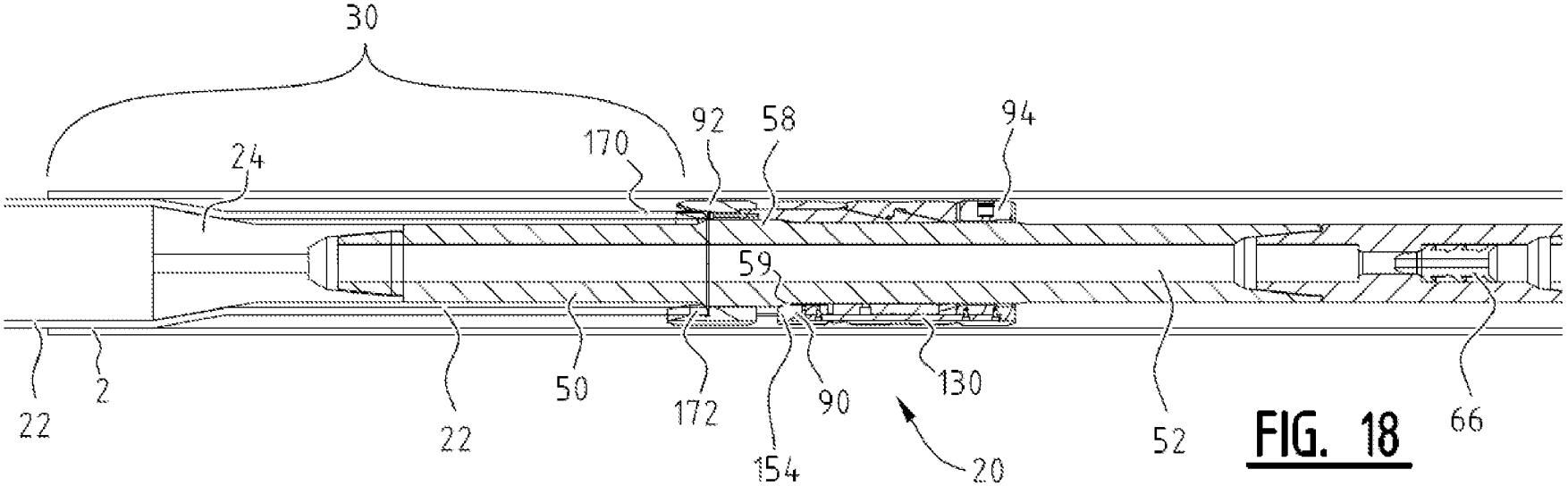

Subsequently, the drill string 8 is pulled towards surface. The expander cone 24 will move in the uphole direction. If L1 exceeds zero, the expandable liner will move in the direction of the activated top anchor 20, until the top end 170 of the liner 22 engages the downhole end 172 of the top anchor. The drill string 8 may then pull the expansion member 24 through the expandable tubular 22 while the top anchor 20 holds the liner 22 in place. As shown in FIG. 18, the expansion member 24 will expand the expandable liner. Depending on the diameter of the expansion member 24, the casing 2 may be expanded too along the overlap section 30.

If the system includes the optional open hole anchor 60, expanding the expandable liner will activate said open hole anchor. When the open hole anchor is activated and has engaged the wellbore wall, the expansion member 24 may then move through the remainder of the expandable tubular 22. The open hole anchor will hold the liner in tension. The liner will shorten due to the expansion process which will consequently open the gap L1.

When the release sub 58 reaches the top anchor 20, the release sub 58 will slide under the centralizer 92 into the clearance 150, until the release sub engages the release ring 90 (FIG. 18). The ridge chamfer 59 of the release sub will for instance engage the release ring chamfer 154 (shown in FIG. 8B), and push the release ring in the uphole direction. The release ring 90 is connected to the pusher ring 94 via the key merlons 130, which hence move in conjunction. As the anchor segments 84 are enclosed between the pusher ring 94 and the release ring 90, the segments 84 also slide radially inward along the ramp surfaces 82, releasing the casing inner surface. The release force required to release the segments may be relatively modest. Said release force may for instance be determined by the spring force of the springs 88. In an embodiment, said force may be in the order of 20-40 kg (about 45-90 pounds force).

With the segments disengaged from the casing, the release sub will forward the top anchor together with the drill string towards surface. The tool string 8 may pull the expansion member 24 through the remainder of the expandable tubular 22 to further expand the latter. After expansion, the expansion assembly 10, without the expandable tubular 22, may be removed from the wellbore.

The expandable liner may be expanded against the wellbore wall and/or as a clad against the inner surface of another tubular element, e.g. a previous casing or liner.

FIG. 18 shows the expandable liner being expanded against the inner surface of the casing 2. At the overlap section 30, the expandable liner 22 and the casing 2 may also be expanded together, for instance to expand the expandable liner and also the overlap section 30 to an inner diameter which is about equal to the inner diameter of the casing 2 (not shown). If so, the liner 22 and the casing 2 will be expanded, and the respective cement 4 in the annulus will be compacted. Thus, the liner 22 may be expanded to an inner diameter which is about equal to the inner diameter of the casing 2, to create a monodiameter wellbore.

The drilling rig 12 may be any system capable of supporting tools for a wellbore. Also, the drilling rig may be located either onshore or offshore. The gripping member 18, as shown, is a set of slips. However, the gripping member 18 may be any suitable member capable of supporting the weight of the tool string 8 and the expansion assembly from the rig floor 16 including, but not limited to, a clamp, a spider, and a rotary table. The hoisting assembly 14 is configured to lower and raise the tool string 8 and thereby the expansion assembly 10 into and out of the wellbore 1. The hoisting assembly 14 is configured to provide the pulling force required to move the expansion member 24 through the expandable tubular 22 during the expansion process. Because the hoisting assembly 14 is coupled to the drilling rig 12, the hoisting assembly 14 is capable of providing a large force to the expansion member 24. The hoisting assembly 14 may be any suitable assembly configured to raise and lower the tool string 8 in the wellbore including, but not limited to, a traveling block, a top drive, a surface jack system, or a subbing unit hoisting conveyance. The hoisting assembly 14 and/or a spinning member located on the rig floor may provide the rotation required to operate the expansion assembly 10.

The present invention is likewise suitable for use with alternative drilling systems. The latter may include for instance a downhole motor instead of a top drive. Said downhole motor is a drilling tool comprised in the drill string directly above the bit. Activated by pressurized drilling fluid, it causes the bit to turn while the drill string does not rotate. Examples of the downhole motor include a positive-displacement motor and a downhole turbine motor. Also, any other drilling tool may be deployed to drill the borehole. Such drilling tool may include, for instance, an abrasive jetting device suspended at the end of the tool string.

The present invention is likewise suitable for directional drilling, i.e. drilling wherein the drilling direction can be adjusted. For instance, a downhole motor may be used as a deflection tool in directional drilling, where it is made up between the bit and a bent sub, or the housing of the motor itself may be bent.

In a practical embodiment, the expandable liner may have a length in the range of for instance 10 m to 3 km. The liner for instance may have a length of 1 to 2.5 km (about 7000 feet).

The present invention is not limited to the above-described embodiments thereof, wherein various modifications are conceivable within the scope of the appended claims. Features of respective embodiments may for instance be combined.

We claim:

1. An expansion assembly for expanding a tubular in a wellbore; the expansion assembly including a top anchor, the top anchor comprising:

a workstring;

a pusher ring being coupled to the workstring by a first releasable coupling;

a ramp body having one or more ramp surfaces, said ramp body being releasably coupled to the workstring by a second releasable coupling, the second releasable coupling upon re ease allowing the workstring to move with respect to said top anchor;

one or more anchor segments each having one or more wedge surfaces corresponding to and engaging the ramp surfaces of the ramp body, a first end of the segments engaging the pusher ring;

a release ring enclosing the workstring and arranged at a second end of the segments, opposite the first end;

one or more key merlons connecting the release ring to the pusher ring and extending axially between the release ring and the pusher ring such that when the release ring is moved in an axial direction the one or more key merlons move the pusher ring in the axial direction in conjunction with the release ring; and activating means for releasing the first releasable coupling allowing the pusher ring to slide along the workstring and push the anchor segments onto the ramp surfaces.

2. The expansion assembly of claim 1, the first releasable coupling including a first set of shear bolts providing a first threshold shear force, the second releasable coupling including a second set of shear bolts having a second threshold shear force, said second threshold shear force exceeding the first threshold shear force.

3. The expansion assembly of claim 1, comprising:

an expansion member connected to a downhole end of the workstring; and an expandable liner enclosing at least part of the workstring between the top anchor and the expansion member.

4. The expansion assembly of claim 3, comprising:

a drill string section extending downhole of the expansion member; and a drill bit arranged at a downhole end of said drill string section.

5. The expansion assembly of claim 4, comprising:

a rotatable tool string which is connected to an uphole end of the workstring for rotating the drill bit and the expansion assembly.

6. The expansion assembly of claim 3, comprising:

a centralizer coupled to a downhole end of the release ring, for centralizing an end of the expandable liner with respect to the workstring.

7. The expansion assembly of claim 6, wherein a downhole end of the centralizer is provided with a centralizing chamfer, for catching and guiding the end of the expandable liner.

8. The expansion assembly of claim 6, wherein the downhole end of the centralizer is arranged at an angle $\gamma>0$ degrees with respect to a radial plane of the top anchor.

9. The expansion assembly of claim 1, wherein the key merlons are arranged between adjacent anchor segments.

10. The expansion assembly of claim 1, the top anchor comprising a spring member arranged between the one or more anchor segments and the corresponding ramp surfaces.

11. The expansion assembly of claim 1, comprising a dart catcher provided in an internal fluid channel of the workstring.

12. The expansion assembly of claim 1, wherein an outside surface of the one or more anchor segments is provided with teeth, each of the teeth having a forward angle $\alpha$ of less than 90 degrees.

13. The expansion assembly of claim 12, wherein the teeth have a forward angle $\alpha$ in the range of 40 to 80 degrees, and an aft angle $\beta$ in the range of about 5 to 30 degrees.

14. A top anchor for an expansion assembly for expanding a tubular in a wellbore, the top anchor comprising:

a workstring;

a pusher ring being coupled to the workstring by a first releasable coupling;

a ramp body having one or more ramp surfaces, said ramp body being releasably coupled to the workstring by a second releasable coupling, the second releasable coupling upon release allowing the workstring to move with respect to said top anchor;

one or more anchor segments each having one or more wedge surfaces corresponding to and engaging the ramp surfaces of the ramp body, a first end of the segments engaging the pusher ring;

a release ring enclosing the workstring and arranged at a second end of the segments, opposite the first end;

one or more key merlons connecting the release ring to the pusher ring and extending axially between the release ring and the pusher ring such that when the release ring is moved in an axial direction the one or more key merlons move the pusher ring in the axial direction in conjunction with the release ring; and activating means for releasing the first releasable coupling allowing the pusher ring to slide along the workstring and push the anchor segments onto the ramp surfaces.

15. The top anchor of claim 14, wherein the key merlons are arranged between adjacent anchor segments.

16. A method for expanding a tubular in a wellbore, the wellbore being provided with a casing, the method comprising the steps of:

introducing a tool string in the wellbore, the tool string being provided with an expansion member, an expandable liner, and a top anchor according to claim 14;

hydraulically activating the top anchor to anchor the top anchor to the casing;

pulling the tool string towards surface to release a second releasable coupling and to allow the tool string to move with respect to said top anchor;

using the tool string to pull the expansion member through the expandable liner towards the top anchor; and deactivating the top anchor.

17. The method of claim 16, wherein the key merlons of the top anchor are arranged between adjacent anchor segments.

* * * * *